US005273470A

United States Patent [19]

Sneddon et al.

[11] Patent Number: 5,273,470

[45] Date of Patent: Dec. 28, 1993

[54] BODYBOARD WITH RIDER-PURCHASE ENHANCING REGIONS

[75] Inventors: Thomas M. Sneddon, Panorama City; Antoine J. Bordier, Studio City, both of Calif.

[73] Assignee: Kransco, San Francisco, Calif.

[21] Appl. No.: 912,802

[22] Filed: Jul. 13, 1992

[51] Int. Cl.[5] ..... B63B 35/81

[52] U.S. Cl. ..... 441/65

[58] Field of Search ..... 441/129, 65; 472/128, 472/129

[56] References Cited

U.S. PATENT DOCUMENTS

| | | | |
|---|---|---|---|
| 3,384,910 | 5/1968 | Heston, Jr. et al. | 9/310 |
| 4,406,628 | 9/1983 | Rademacher | 441/129 X |
| 4,437,842 | 3/1984 | Connor | 441/65 |
| 4,439,165 | 3/1984 | Rothstein | 441/74 |
| 4,752,260 | 6/1988 | Stewart | 441/65 |
| 4,781,638 | 11/1988 | Winter, Jr. | 441/129 |
| 4,894,034 | 1/1990 | Brown, III | 441/65 |
| 5,116,626 | 5/1992 | Moran | 441/65 |

*Primary Examiner*—Sherman Basinger
*Attorney, Agent, or Firm*—Kolisch, Hartwell, Dickinson, McCormack & Heuser

[57] ABSTRACT

A bodyboard is provided having a top riding surface with a purchase-enhancing region disposed thereon. The purchase-enhancing region includes plural ridges which extend diagonally thereacross to impede forward shift of a bodyboard rider.

14 Claims, 3 Drawing Sheets

10
11
12
14
16
18
20
22
26
28
28a
28a1
28a2
28b
32
36
38
E
F
G

BODYBOARD WITH RIDER-PURCHASE ENHANCING REGIONS

BACKGROUND AND SUMMARY OF THE INVENTION

The present invention relates generally to sporting goods and recreational products and more particularly to a bodyboard for use in supporting a rider during travel in ocean surf.

As is well-known in the art, bodyboards are flotation devices somewhat similar to surfboards, the major differences being that bodyboards are shorter in length, lighter in construction, and are generally more flexible. Bodyboards are commonly formed from elongate, semi-rigid foam planks, the finished board including a top riding surface and a bottom planing surface. The bottom surface of the board is usually slick. enhancing bodyboard planing during travel in the surf.

Bodyboard enthusiasts most often ride their boards in a prone position, one arm extending forwardly to grip the nose end of the board and the other arm extending along the rider's side to grip a side edge of the board. Control of the board is exercised by pushing or pulling against its front and side edges, bending or twisting the board to effect turning action. The rider's legs, which most often trail the board, may also aid in bodyboard steering and maneuvering.

In order to gain leverage, riders often raise their bodies somewhat off the surface of the board by propping themselves up on the elbow of their forwardly-extending arm. When in such a position, a rider's elbow may be used as a fulcrum, allowing the rider to bend or twist the board about such elbow, and consequently to direct travel across the surf. Where additional challenge is desired, more experienced riders may desire to kneel or stand on the board, adding an additional dynamic element to bodyboard control.

Bodyboarding is a very fast-paced and exhilarating sport, which has evolved to include competitions where tricks and maneuvers requiring a high degree of coordination and aggressiveness are attempted. Tricks such as the "EL Rollo," the "Drop Me Off," and the "Belly 360" are among these maneuvers, each requiring daring and precise turns. Not surprisingly, these tricks mandate that the rider have complete control over the board, and consequently that the rider maintain close association with the board. To exercise control, the rider must thus be able to grip the board securely. This may be difficult, however, due to the speeds involved, the trajectory of a planing board, and the water which usually covers the board during its use.

As a result of the above-cited factors, riders of conventional boards have tended to plane off the surface of the board, prematurely ending the ride. Bodyboards have thus been provided which attempt to improve board grippability, such boards having blunt nose ends intended to provide riders with a handhold which may be comfortably gripped with the hand of a forwardly extending arm. Using the rider's other hand, the rider may similarly grip the board along a side edge, pulling the side of the board upwardly to effect further control over the board.

Despite the above-described provisions, conventional bodyboards are still characterized by unwanted shift of the rider, such shift commonly being evident in the relationship between the board and the rider's hands and arms. For example, because conventional bodyboards are generally flat, a rider's hands may easily slip off the nose end or the side edge of the board, resulting in an aborted or out-of-control ride. Similarly, the elbow of the rider's forwardly-extending arm, about which the board is pivoted to effect sharp turns, may slide off the board's riding surface, again leading to a loss of board control. Undesirable shift of the rider's torso is yet another common problem, such shift further impeding enjoyment of the bodyboarding experience. In any case, for a rider to perform long, drawn-out turns, short "snappy" turns, or the wide variety of tricks in competitions, the board must provide for stable purchase of the rider during its use. Such purchase is unavailable in conventional bodyboards. It is therefore an object of this invention to provide a bodyboard which improves purchase of the rider.

In order to address the above-discussed problems, bodyboards have been developed which include side edges of improved shape, providing a more secure rider handhold. Such bodyboards, as for example those disclosed in U.S. Pat. Nos. 4,894,034 and 5,116,269, attempt to address the problem of rider shift by providing a lip along each of the board's side edges, such lips extending from the board's nose to position near the rear of the board. These lips, however, do little to impede forward shift of the rider's torso or to impede shift of the rider's elbows or knees which generally engage the top surface of the board. Consequently, when the rider passes through a wave, the rider's orientation relative the board may change, substantially, detrimentally effecting the rider's control. It is therefore an object of the present invention to provide a bodyboard with a riding surface which enhances purchase of the rider.

Additionally, although bodyboards having lips along the side edges thereof are effective in providing the rider with an area to comfortably grip, such lips do little to impede forward shift of the rider's hand along the board's side edge. Such forward shifting effects the rider's ability to pull up on the board and thus impairs the rider's ability to effect control. It is therefore an object of the present invention to provide a bodyboard which affords improved gripping of the board in a manner impeding forward shift of the rider's hands.

Accordingly, the present invention provides an improved bodyboard for use in supporting a rider during travel in the ocean surf. The bodyboard includes an elongate, substantially planar board having a top riding surface on which the rider is mounted, and a slick, bottom planing surface which glides across the surface of the water. The board is perimetrically defined by a forward nose end, a rear tail end, and a pair of elongate, laterally-opposed side edges.

As a principle feature of the invention, the top riding surface of the board is provided with a purchase-enhancing region adapted to aid in purchase of the rider. The purchase-enhancing region is divided into forward and rear expenses, the forward expanse including ridges which impede forward shift of the rider. The ridges extend diagonally across the region to oppose both forward and lateral shift of the rider.

In order to further impede rider shift, the top riding surface is provided with a torso-supporting region which is suited to allow transverse shifting of the rider's torso while impeding forward shift of the same. A forward grip region is also provided, the grip region having a lip which extends adjacent the nose end of the board to improve the rider's forward grip and thus to further impede rider shift.

DETAILED DESCRIPTION OF THE PREFERRED EMBODIMENT

As stated above, the present invention concerns a bodyboard of the type used during travel in the ocean surf. The bodyboard is specially adapted to enhance purchase of a rider, providing the rider with exceptional control and with the ability to perform a collection of difficult maneuvers. Toward this end, the invented bodyboard is provided with a top riding surface specially contoured to aid in maintaining stable association of the rider and the board.

Figures 1, 3, 4, 5:
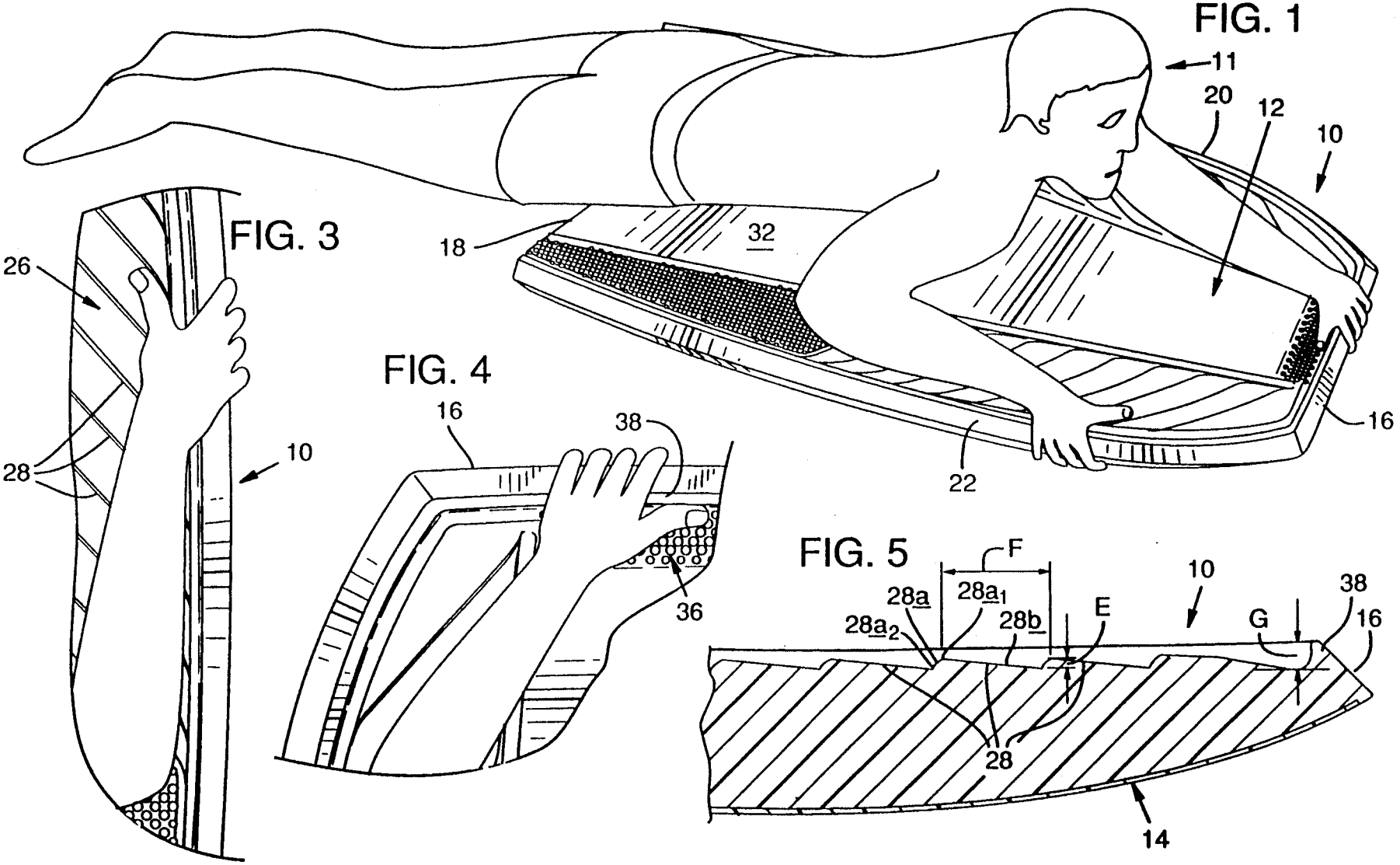
FIG. 1 is a perspective view of a rider positioned on a bodyboard according to the present invention, the rider being positioned in an orientation typical of that employed in the sport of bodyboarding.
FIG. 3 is an enlarged partial plan view of the purchase-enhancing region of the invented bodyboard, showing a typical orientation of a rider's side-edge-gripping hand.
FIG. 4 is an enlarged partial plan view of the forward grip region of the invented bodyboard, showing a typical grip orientation of a rider's forward-end-gripping hand.
FIG. 5 is a sectional view of the bodyboard of the present invention taken along lines 5—5 of FIG. 2.

Upon reference to the drawings, the reader will observe that a preferred embodiment of the invented bodyboard has been depicted, such bodyboard being indicated generally at 10. Referring initially to FIG. 1, and beginning with a general description of the invented bodyboard, it will be noted that bodyboard 10 is an elongate, substantially planar board, such board preferably having a length of approximately 42-inches and a width of approximately 22-inches. As will be appreciated, the board is well suited for supporting an individual such as rider 11 during travel in ocean surf. The bodyboard includes a top riding surface 12, a bottom planing surface 14 (see FIGS. 5–8), a blunt front nose end 16, a radiused rear tail end 18 and a pair of laterally opposed side edges 20, 22.

Board 10 is formed from a water-buoyant foam material such as WAVECORE TM, which is a high quality ETHAFOAM ® product made by Dow Plastics. The foam core is relatively stiff and dense, and although resiliently deformable, will tend to retain its shape if bent or twisted by the rider. As will be appreciated by those skilled in the art, the core may be formed from a single piece of foam or constructed using plural foam components, with or without additional structural support. The bottom surface of board 10 is covered with a friction-reducing material, providing a planing surface which is tough and resilient. In the preferred embodiment, the bottom of the board is covered with SURLYN ®, a plastic product made by DuPont.

Although a rider may mount bodyboard 10 in any of a variety of riding positions, the board is typically mounted with the rider in a prone position similar to that shown in FIG. 1. In this position, one of the rider's arms, referred to herein as the leading or forward arm, extends forwardly, the corresponding hand gripping the nose end of the board. The other arm, referred to herein as the trailing arm, is disposed along the rider's side, the hand of such arm gripping the board along one of the board's side edges. The rider's body is generally transversely centered on the board with the rider's chest raised to allow board deformation as described above.

Those familiar with the sport of bodyboarding will recognize that a number of alternative riding positions may be used, such positions characterizing various degrees of control and maneuverability. One such position places the rider in a kneeling position on the bodyboard, the foot of one leg being placed on the top surface of the board near its forward end and the knee of the other leg being placed near the rear end of the board. Rider purchase, in such a position, relies entirely on the relationship between the rider and the top surface of the board, a relationship which is enhanced by features described below. In any event, the rider must try to maintain a stable relationship with the board so that control may be exercised during travel through the surf.

Figure 2:
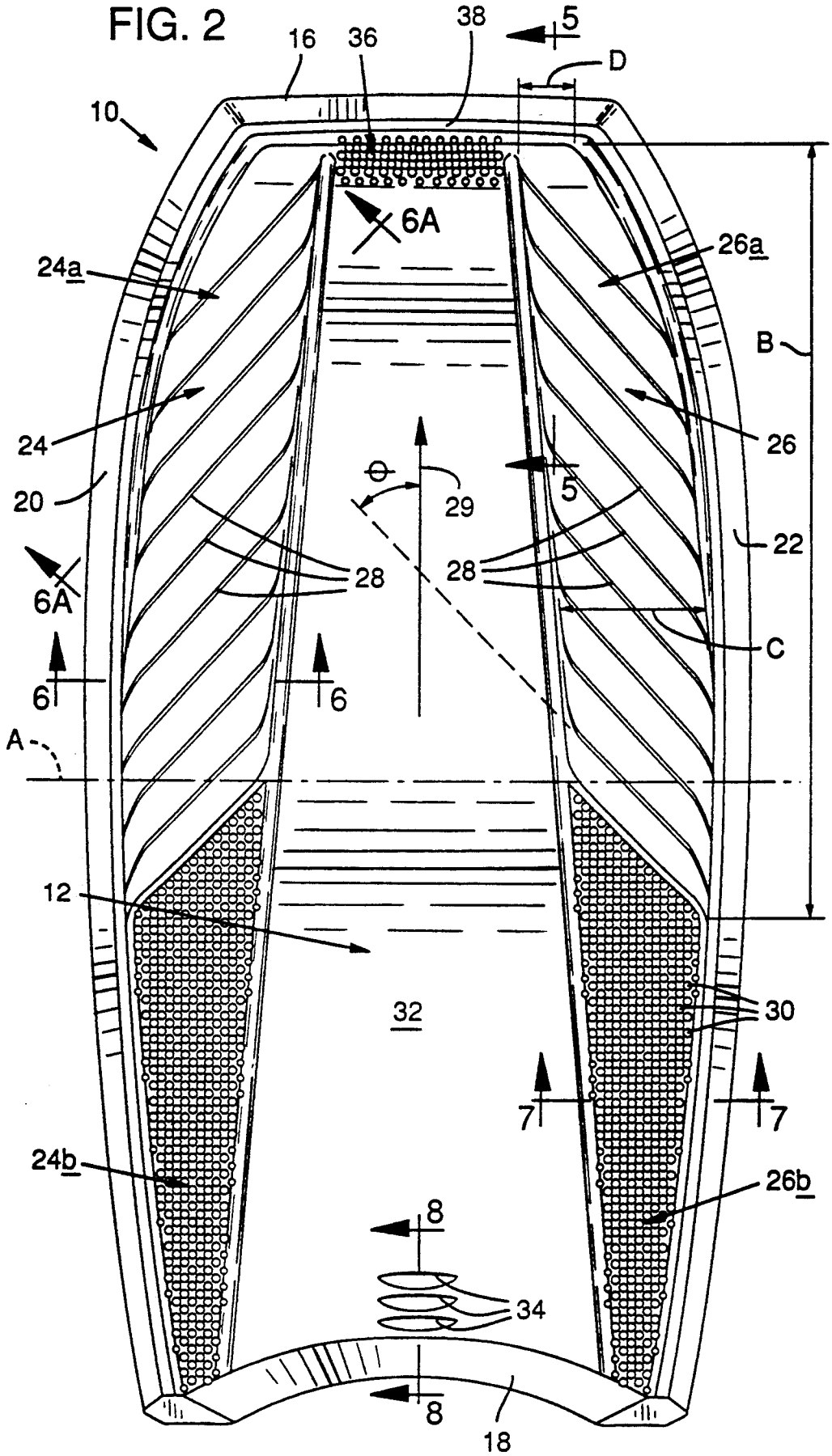
FIG. 2 is a top plan view of the bodyboard of the present invention.

Turning now to FIG. 2, the reader will see that, top riding surface 12 is provided with a pair of purchase-enhancing regions such as those shown at 24 and 26, each such region extending adjacent one of the board's opposite side edges along the length of the board. The regions are substantially mirror images of one another, each serving to aid in maintaining a stable relationship between the rider and the board by impeding forward shift of the board's rider.

For purposes of illustration, a generally central, transverse axis A is shown intersecting board 10, each purchase-enhancing region being somewhat correspondingly divided into a forward expanse **24*a*, 26*a* and a rear expanse 24*b*, 26*b*. As shown, forward expanse 26*a* is generally elongate, having a length B of approximately 24-inches. The width of expanse 26*a* varies along its length, such width tapering both forwardly and rearwardly from a somewhat centralized maximum width C of approximately 5-inches. Forward expanse 26*a* tapers forwardly to a width D of approximately 2.5-inches and rearwardly to a point of zero width. As should be appreciated, the dimensions of forward expanse 24*a* are substantially identical to the dimensions of expanse 26*a***.

Continuing with the description of forward expanses **24*a* and 26*a*, it will be noted that each expanse includes ridge means such as ridges 28, the ridges being adapted for selected purchase of a rider in a manner to be described below. As indicated, ridges 28 preferably extend diagonally across the purchase-enhancing regions, inhibiting both forward and lateral rider shift. Toward this end, ridges 28 preferably extend forwardly and inwardly from adjacent one of the side edges at an angle $\theta$ of approximately 45° from the direction of travel as represented by arrow 29 in FIG. 2**.

Focusing now on FIG. 5, the reader will recognize that ridges 28 may be thought of as a series of steps, each step including a riser **28*a* and a run 28*b*. As indicated, a distance F separates adjacent risers, such distance preferably corresponding to a distance of approximately 2-inches. The risers are generally vertical, having a height of approximately E. Height E, in the preferred embodiment, corresponds to a distance of approximately 0.125-inch (⅛-inch), the riser being rounded to provide an effective but comfortable stop against which the rider's hand, foot, elbow or knee may abut. Consequently, ridges 28** serve as an impediment to the rider shift where any of a wide variety of riding positions are used. Where the rider employs the depicted riding position, for example, the thumb of the rider's trailing arm is positioned directly to the rear of a riser of one of the purchase-enhancing regions and the elbow of the rider's leading arm is positioned directly to the rear of a riser of the other purchase-enhancing region.

Referring still to FIG. 5, it will be noted that each riser includes an upper edge 28$a_1$, and a lower edge 28$a_2$. Runs such as 28*b* separate adjacent risers, the runs extending in the direction of travel between the upper edge of one riser and the lower edge of the next-forward riser. Each run preferably slopes downwardly toward the lower edge of the next-forward riser.

In FIG. 3 the manner in which the purchase-enhancing regions enhance purchase of the rider is illustrated, such illustration showing the hand of the rider's trailing arm in a board-gripping orientation. It will be understood that, although the rider's right arm is chosen for illustration as the trailing arm, the left arm may be so used with similar effect. As indicated, the rider grips one of the board's side edges with the hand of the trailing arm, the rider's thumb being placed on the riding surface of the board. Such thumb selectively rests on one of the runs. The run underlies the rider's thumb, passing across the purchase-enhancing region in a direction corresponding to the direction in which a rider's thumb comfortably extends upon gripping of the side edge of the board. The meaty part of rider's thumb engages the next-forward riser, such riser acting as a stop to prevent forward or lateral shift of the thumb. Consequently, the rider's grip is enhanced and shift of the rider is impeded. It should be appreciated that the above-described steps may similarly be used for purchasing the elbow of the rider's trailing arm. In such an instance, the rider's elbow rests on the run of a step, engaging the riser of the next-forward step.

Figure 6A:
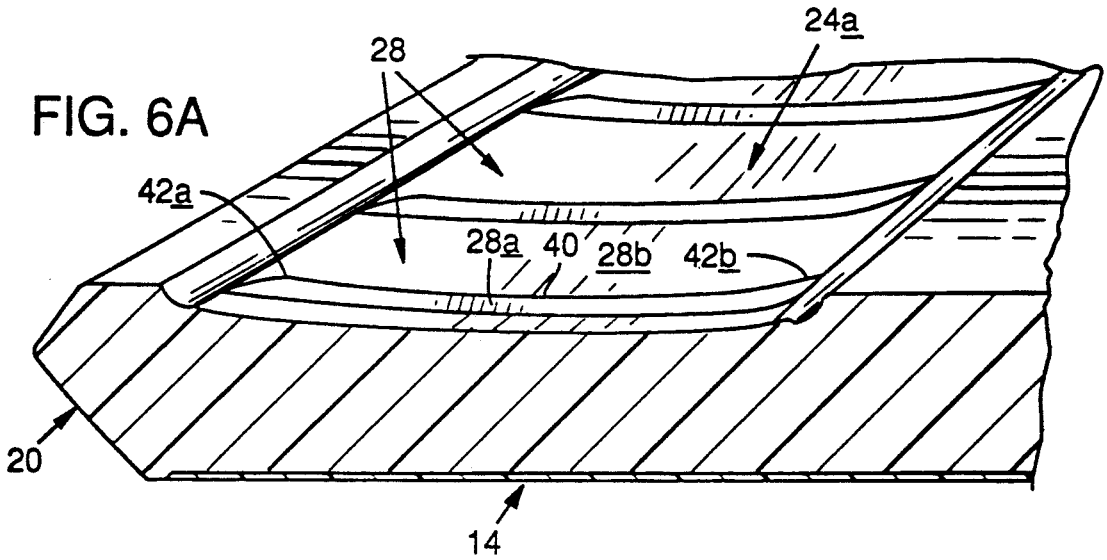
FIG. 6A is a partial sectional perspective view of the invented bodyboard taken along lines 6A—6A of FIG. 2.
Figure 6:
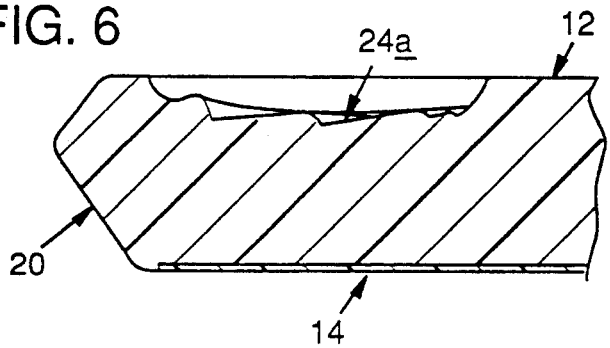
FIG. 6 is a sectional view of the bodyboard of the present invention taken along lines 6—6 of FIG. 2.
Figure 7:
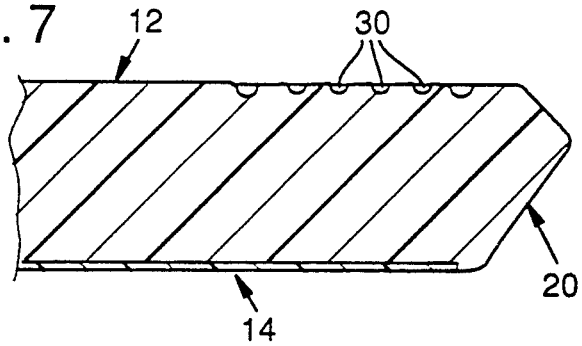
FIG. 7 is a sectional view of the bodyboard of the present invention taken along lines 7—7 of FIG. 2.

Looking for a moment to FIGS. 6 and 6A, it should be appreciated that board 10 defines a generally arcuate, trough-shaped well in the area of forward expanse 24*a*. The well is of a curvature such that each ridge 28 dips adjacent its center 40 to a level approximately 0.125-inch (⅛-inch) below its level at adjacent ends 42*a*, 42*b*. Such dip is best shown in FIG. 6A wherein arcuate risers such as at 28*a* and runs such as at 28*b* of consecutive steps are shown. A similar well is defined in the area of expanse 26*a*. Each such well is of a size suitable for receipt of a rider's arm, such arm, when placed within the well, tending toward a predefined positional resting place within the well. The tendency toward maintaining the arm's position is thus enhanced by the well, further improving rider purchase.

Although not specifically shown, the board may also serve to enhance rider purchase when the rider is positioned in other than a prone position. For example, where, as is sometimes desired, a rider kneels on the riding surface of the board, the above-defined ridges may result in purchase of the rider's knees, and/or the rider's feet, the risers acting as stops to prevent forward shift thereof. In such a situation, the rider's legs tend toward seating within the wells described above.

Figure 8:
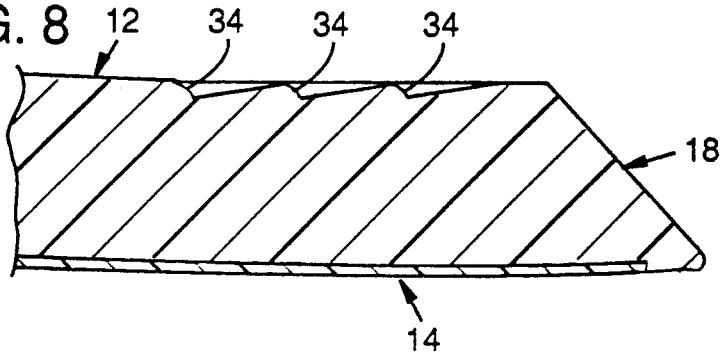
FIG. 8 is a sectional view of the bodyboard of the present invention taken along lines 8—8 of FIG. 2.

Returning to a discussion of FIG. 2, and bringing FIG. 8 into the discussion, it will be seen that the purchase-enhancing regions further include plural dimples such as at 30. Such dimples serve to aid in purchase of the rider by complementary operative association with the rider's skin. Preferably, the dimples are formed in the rear expanses of each purchase enhancing region, and are specifically suited for cooperative frictional engagement with the rider's torso or legs. Although dimples of various shapes and sizes may be used to effect such frictional engagement dimples, having a diameter of approximately 0.25-inch (¼-inch) and a depth of approximately 0.125-inch (⅛-inch) have proven to be particularly suited for this purpose. Dimples which are significantly larger may hold water, serving as a lubricant rather than an adherent element and may provide an uncomfortable surface on which the rider rests. Smaller dimples may similarly fail to produce the desired frictional effect, such dimples not being well adapted for the desired operative association with the skin of a rider.

Bodyboard 10 also includes a generally centralized torso-supporting region 32 on which the rider's torso may rest. The torso-supporting region is generally smooth, but not slick, allowing the rider to selectively shift from side to side for obtaining the desired maneuverability. As shown in FIGS. 2 and 8, grooves 34 are defined in an area proximate the tail end of the board's torso-supporting region, such grooves serving to impede forward shift of the rider's torso. Grooves 34 are transverse, tapering into the surface of the torso supporting regions adjacent opposite ends thereof. The grooves are generally adapted for complementary operative association with the skin of a rider's torso, such skin generally being deformable to fill the grooves. In this manner, the grooves serve to prevent forward shift of the rider's torso while generally allowing side-to-side shift as necessary.

Top riding surface 12 also includes a forward grip region 36, such grip region being suited for purchase of the rider's hand. Referring to FIGS. 4 and 5, the reader will see that the grip region includes a transverse lip 38 which extends generally along the forward nose end of the board. The lip projects upwardly a distance G such that the lip may purchase the thumb and/or the palm of a rider's hand. In the preferred embodiment distance G is approximately 0.375-inch (⅜-inch). In addition, region 36 includes a plurality of dimples similar to those described in association with the purchase-enhancing regions above. Such dimples act as a further impediment to forward shift of the rider's hand.

Although FIG. 4 shows one position of the rider's hand, it is contemplated that the hand may be selectively shifted by an individual for purposes of comfort and riding action. Such is similarly the case with the trailing hand which may be selectively maintained in a plurality of secure positions relative to the length of an associated edge by virtue of the plural risers described above.

The features described with reference to the foregoing bodyboard provide substantial advantages in riding, whether tricks or more routine maneuvers are being performed. The purchase-enhancing regions, and the associated ridge means, make for a board which is under more complete control of the rider and thus a board which allows for improved control during planing through the ocean surf.

While the present invention has been shown and described with reference to the foregoing preferred embodiment, it will be apparent to those skilled in the art that other changes and form and detail may be made without departing from the scope and spirit of the invention as defined in the appended claims.

It is claimed:

1. A bodyboard used for supporting a rider during travel in ocean surf comprising:

an elongate, substantially planar board having a top riding surface, a bottom planing surface, a forward nose end, a rear tail end, and a pair of elongate, laterally-opposed side edges; and the top riding surface including a centralized torso-supporting region for underlying the rider's torso and a purchase-enhancing region extending substantially from one of the side edges to the torso supporting region, the purchase-enhancing region having an elongate expanse forward of a central transverse axis, the expanse including a plurality of spaced-apart elongate ridges, each of which includes an elongate riser extending diagonally across the expanse to impede forward and lateral shift of the rider's hand when the hand is positioned adjacent a selected ridge.

2. The bodyboard of claim 1, wherein the risers extend forwardly from adjacent one of the side edges.

3. The bodyboard of claim 1, wherein the purchase-enhancing region defines a plurality of dimples.

4. The bodyboard of claim 3, wherein the dimples have a diameter of approximately ¼-inch and a depth of approximately ⅛-inch.

5. The bodyboard of claim 1, wherein the torso-supporting region defines a plurality of grooves for impeding forward slip of the rider's torso.

6. The bodyboard of claim 1, wherein the top riding surface further includes a forward grip region having a lip extending along the forward nose end, such lip projecting upwardly from the plane of the board for selected purchase of the rider's hand.

7. The bodyboard of claim 6, wherein the forward grip region defines a plurality of dimples adjacent the lip for impeding forward shift of the rider's hand.

8. A bodyboard used for supporting a rider during travel in ocean surf comprising:

an elongate, substantially planar board having a top riding surface, a bottom planing surface, a forward nose end, a rear tail end, and a pair of elongate, laterally-opposed side edges; and the top riding surface including a centralized torso-supporting region for underlying the rider's torso and a purchase-enhancing region having an elongate expanse forward of a central transverse axis, the expanse including a series of steps, each step having a substantially vertical riser which extends upwardly from another step for selected purchase of the rider.

9. The bodyboard of claim 8, wherein adjacent risers are separated by runs.

10. The bodyboard of claim 9, wherein each riser includes an upper edge and a lower edge, the runs extending between the upper edge of a first riser and the lower edge of a next-forward riser.

11. The bodyboard of claim 10, wherein each run slopes downwardly toward the lower edge of the next-forward riser.

12. A bodyboard used for supporting a rider during travel in ocean surf comprising:

an elongate, substantially planar board having a top riding surface, a bottom planing surface, a forward nose end, a rear tail end, and a pair of elongate, laterally-opposed side edges;

the top riding surface including a centralized torso-supporting region for underlying the rider's torso and a purchase-enhancing region having an expanse forward of a central transverse axis, the expanse including an elongate, trough-shaped well with a plurality of ridges extending thereacross, the well extending substantially the length of such expanse for purchase of a rider's arm to prevent transverse and longitudinal shift thereof.

13. A bodyboard for use in supporting a rider during travel in ocean surf, the bodyboard including an elongate, substantially planar board having a top riding surface, a bottom planing surface, a forward nose end, a rear tail end, and a pair of elongate, laterally-opposed side edges, the top riding surface comprising:

a forward grip region having a lip which extends along the forward nose end, such lip projecting upwardly from the plane of the board for selected purchase of the rider's hand;

a centralized torso-supporting region having at least one transverse groove for selected purchase of the rider's torso to impede forward shift thereof; and a pair of elongate, purchase-enhancing regions, each extending along a side edge of the board and having an expanse forward of a central transverse axis, each expanse having a series of diagonal ridges adapted for selected purchase of the rider's hand.

14. A bodyboard used for supporting a rider during travel in ocean surf comprising:

an elongate, substantially planar board having a top riding surface, a bottom planing surface, a forward nose end, a rear tail end, and a pair of elongate, laterally-opposed side edges; and the top riding surface including a centralized torso-supporting region for underlying the rider's torso, a purchase-enhancing region having an elongate expanse forward of a central transverse axis, the expanse including a plurality of elongate ridges, each extending across the expanse selectively to impede forward shift of the rider, and a forward grip region having a lip extending along the forward nose end and a plurality of dimples adjacent the lip for impeding forward shift of the rider's hand, the lip projecting upwardly from the plane of the board for selected purchase of the rider's hand.

* * * * *

US005273470B1

REEXAMINATION CERTIFICATE (4136th)

United States Patent [19] [11] B1 5,273,470

Sneddon et al. [45] Certificate Issued Aug. 22, 2000

[54] BODYBOARD WITH RIDER-PURCHASE ENHANCING REGIONS

[75] Inventors: Thomas M. Sneddon, Panorama City; Antoine J. Bordier, Studio City, both of Calif.

[73] Assignee: Wham-O, Inc.

Reexamination Request:
No. 90/005,174, Dec. 1, 1998

Reexamination Certificate for:

| | |
|---|---|
| Patent No.: | **5,273,470** |
| Issued: | **Dec. 28, 1993** |
| Appl. No.: | **07/912,802** |
| Filed: | **Jul. 13, 1992** |

[51] Int. Cl.[7] ..... B38B 35/81

[52] U.S. Cl. ..... 441/65; D21/803

[58] Field of Search ..... 441/129, 65; 472/128, 472/129

[56] References Cited

U.S. PATENT DOCUMENTS 5,114,370 5/1992 Moran ..... 441/65
5,224,890 7/1993 Moran .

*Primary Examiner*—Sherman Basinger

[57] ABSTRACT

A bodyboard is provided having a top riding surface with a purchase-enhancing region disposed thereon. The purchase-enhancing region includes plural ridges which extend diagonally thereacross to impede forward shift of a bodyboard rider.

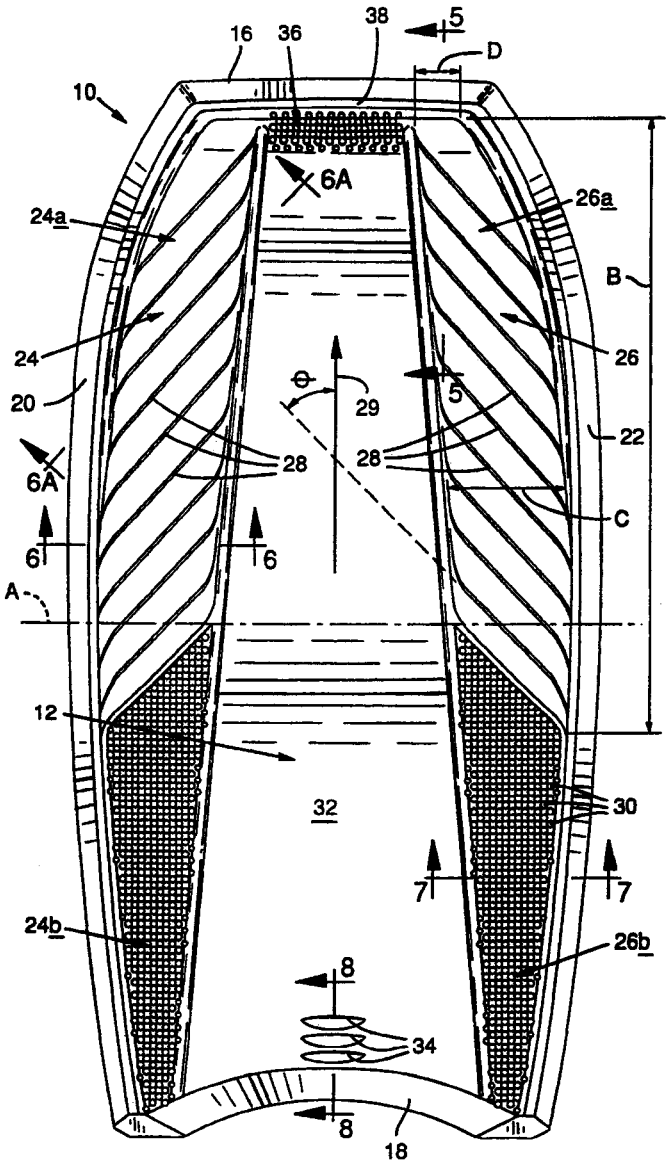

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–14 is confirmed.

Claim 1 is determined to be patentable as amended.

Claims 2–7, dependent on an amended claim, are determined to be patentable.

New claims 15–31 are added and determined to be patentable.

1. A bodyboard used for supporting a rider during travel in ocean surf comprising:

an elongate, substantially planar board having a top riding surface, a bottom planing surface, a forward nose end, a rear tail end, and a pair of elongate, laterally-opposed side edges; and the top riding surface including a centralized torso-supporting region for underlying the rider's torso and a purchase-enhancing region extending substantially from one of the side edges to the torso supporting region, the purchase-enhancing region having an elongate expanse forward of a central transverse axis, the expanse including a plurality of spaced-apart elongate ridges, each of which includes an elongate riser extending diagonally across the expanse, *wherein the riser is configured* to impede forward and lateral shift of the rider's hand when the hand is positioned adjacent a selected ridge.

*15. The bodyboard of claim 13, wherein the at least one groove is defined rearward of the central transverse axis.*

*16. The bodyboard of claim 13, wherein the at least one groove is defined in an area proximate the tail end.*

*17. The bodyboard of claim 1, wherein the torso-supporting region includes means, rearward of the central transverse axis, for impeding forward slip of the rider's torso.*

*18. The bodyboard of claim 17, wherein the means for impeding forward slip of the rider's torso includes one or more grooves.*

*19. The bodyboard of claim 17, wherein the means for impeding forward slip of the rider's torso includes means defined in an area proximate the tail end.*

*20. The bodyboard of claim 1, wherein the torso-supporting region includes means, rearward of the expanse, for impeding forward slip of the rider's torso.*

*21. The bodyboard of claim 20, wherein the means for impeding forward slip of the rider's torso includes one or more grooves.*

*22. he bodyboard of claim 20, wherein the means for impeding forward slip of the rider's torso includes means defined in an area proximate the tail end.*

*23. A bodyboard used for supporting a rider during travel in ocean surf comprising:*

*an elongate, substantially planar board having a top riding surface, a bottom planing surface, a forward nose end, a rear tail end, and a pair of elongate, laterally-opposed side edges;*

*the top riding surface including a centralized torso-supporting region for underlying the rider's torso and a purchase-enhancing region having an expanse forward of a central transverse axis, the expanse including an elongate, arcuate well with a plurality of ridges extending thereacross, the well extending substantially the length of such expanse for purchase of a rider's arm to prevent transverse and longitudinal shift thereof.*

*24. A bodyboard used for supporting a rider during travel in ocean surf comprising:*

*an elongate substantially planar board having a top riding surface, a bottom planing surface, a forward nose end, a rear tail end, and a pair of elongate, laterally-opposed side edges;*

*the top riding surface including a centralized torso-supporting region for underlying the rider's torso and a purchase-enhancing region extending substantially from one of the side edges to the torso supporting region, the purchase-enhancing region having an elongate expanse forward of a central transverse axis, the expanse including a plurality of spaced-apart elongate ridges, each of which includes an elongate, generally vertical riser extending diagonally across the expanse to impede forward and lateral shift of the rider's hand when the hand is positioned adjacent a selected ridge, and an elongate run extending diagonally across the expanse from an edge of the riser to the next adjacent riser.*

*25. The bodyboard of claim 24, wherein the torso-supporting region includes means, rearward of the central transverse axis, for impeding forward shift of the rider's torso.*

*26. The bodyboard of claim 25, wherein the means for impeding forward shift of the rider's torso includes means defined in an area proximate the tail end.*

*27. The bodyboard of claim 25, wherein the means for impeding forward shift of the rider's torso includes one or more grooves.*

*28. The bodyboard of claim 24, wherein the torso-supporting region includes means, rearward of the expanse, for impeding forward shift of the rider's torso.*

*29. A bodyboard used for supporting a rider during travel in ocean surf comprising:*

*an elongate, substantially planar board having a top riding surface, a bottom planing surface, a forward nose end, a rear tail end, and a pair of elongate, laterally-opposed side edges; and*

*the top riding surface including a centralized torso-supporting region for underlying the rider's torso and a purchase-enhancing region extending substantially from one of the side edges to the torso supporting region, the purchase-enhancing region having an elongate expanse forward of a central transverse axis, the expanse including a plurality of spaced-apart elongate ridges, each of which includes an elongate riser extending diagonally across the expanse to impede forward and lateral shift of the rider's hand when the hand is positioned adjacent a selected ridge;*

*wherein the purchase enhancing region defines a plurality of dimples.*

*30. The bodyboard of claim 29, wherein the dimples have a diameter of approximately ¼-inch and a depth of approximately ⅛-inch.*

*31. A bodyboard used for supporting a rider during travel in ocean surf comprising:*

*an elongate, substantially planar board having a top riding surface, a bottom planing surface, a forward nose end, a rear tail end, and a pair of elongate, laterally-opposed side edges; and*

*the top riding surface including a centralized torso-supporting region for underlying the rider's torso and a purchase-enhancing region extending substantially from one of the side edges to the torso supporting region, the purchase-enhancing region having an elongate expanse forward of a central transverse axis, the expanse including a plurality of spaced-apart elongate ridges, each of which includes an elongate riser extending diagonally across the expanse to impede forward and lateral shift of the rider's hand when the hand is positioned adjacent a selected ridge;*

*wherein the top riding surface further includes a forward grip region having a lip extending along the forward nose end, such lip projecting upwardly from the plane of the board for selected purchase of the rider's hand;*

*and wherein the forward grip region defines a plurality of dimples adjacent the lip for impeding forward shift of the rider's hand.*

* * * * *